United States Patent [19]

Muto et al.

[11] 4,071,996

[45] Feb. 7, 1978

[54] PROCESS FOR REINFORCING REINFORCED CONCRETE POST

[75] Inventors: Kiyoshi Muto; Toshihiko Hisada, both of Tokyo; Nobutsugu Ohmori, Chofu; Satoshi Bessho, Tokyo; Naoharu Mori, Yokohama; Katsuhiko Ishikawa, Tokyo, all of Japan

[73] Assignee: Kajima Kensetsu Kabushiki Kaisha, Tokyo, Japan

[21] Appl. No.: 612,225

[22] Filed: Sept. 10, 1975

Related U.S. Application Data

[63] Continuation-in-part of Ser. No. 501,995, Aug. 30, 1974, abandoned, which is a continuation of Ser. No. 303,199, Nov. 2, 1972, abandoned.

[30] Foreign Application Priority Data

| | | |
|---|---|---|
| Nov. 2, 1971 | Japan | 46-87488 |
| Nov. 2, 1971 | Japan | 46-87490 |
| Oct. 6, 1972 | Japan | 47-101023 |

[51] Int. Cl.[2] ..... E04H 9/02

[52] U.S. Cl. ..... 52/741; 264/35; 52/423; 52/725; 52/727

[58] Field of Search ..... 52/741, 283, 653, 423, 52/439, 724–728, 729, 727; 138/160; 61/59; 264/35

[56] References Cited

U.S. PATENT DOCUMENTS

| | | | |
|---|---|---|---|
| 796,227 | 8/1905 | Lally | 52/283 |
| 822,587 | 6/1906 | Cummings | 52/653 |
| 863,555 | 8/1907 | Poole | 52/423 |
| 1,391,352 | 9/1921 | Ward | 52/439 |
| 1,512,660 | 10/1924 | Wright et al. | 61/54 |
| 1,696,934 | 1/1929 | Allen | 52/728 |
| 3,050,161 | 8/1962 | Shlager | 52/727 |
| 3,338,058 | 8/1967 | Young | 61/54 |
| 3,355,852 | 12/1967 | Lally | 52/725 |
| 3,390,951 | 7/1968 | Finger et al. | 61/54 |
| 3,798,867 | 3/1974 | Starling | 52/729 |
| 3,858,374 | 1/1975 | Ben-Zvi | 52/724 |

*Primary Examiner*—James L. Ridgill, Jr.
*Attorney, Agent, or Firm*—Meyer, Tilberry & Body

[57] ABSTRACT

A method of maintaining the load bearing integrity of a pre-existing reinforced concrete post during earthquake tremors wherein a sheet metal band is placed about the post and then made integral thereto by inserting a hardenable bonding agent between the band and the post.

1 Claim, 18 Drawing Figures

PROCESS FOR REINFORCING REINFORCED CONCRETE POST

This application is a continuation-in-part of our copending application Ser. No. 501,995, filed Aug. 30, 1974, now abandoned, which was a continuation of application Ser. No. 303,199, filed Nov. 2, 1972, now abandoned.

This invention pertains to the art of building structures and more particularly to a process for reinforcing concrete posts.

The invention is particularly applicable for use in reinforcing concrete posts in reinforced concrete buildings and will be described with particular reference thereto; however, it will be appreciated by those skilled in the art that the invention has broader applications and may be used in other construction environments where it is desired to reinforce concrete posts. Recently, it has been found that reinforced concrete buildings incurred serious damage due to sharp earthquakes. The first thing pointed out as the cause for such damage in each and every case of these structures was breakdown of posts by shearing forces. It has also been brought to light that a cause contributing to the breakdown by shearing forces lay in the fact that the deformation occurred alternately and repeatedly at a number of frequencies at the time of a severe earthquake. It has been elucidated, through recent research efforts, that the most suitable method of preventing a reinforced concrete post from being subjected to breakdown by shearing caused by such repeated forces and of insuring the stability and toughness of the shearing characteristics thereof is to to at least patially enclose in an effective manner the concrete of such a section as is surrounded by main bars or core concrete.

Since conventional reinforced concrete buildings are not specifically designed to properly take such multifarious, alternative and repeated deformations into consideration, it is evident that conventional posts of reinforced concrete buildings constructed pursuant to existing methods of designing are unable to evade serious damage resulting from severe earthquakes.

The purpose of the present invention lies in providing a method of executing construction work which serves to improve the quakeproof property of any existing reinforced concrete post by enclosing in an effective manner the core concrete of each post with a plurality of sheet steel pieces securely jointed with one another.

Specifically, the present invention comprises a method of covering the peripheral surface of a reinforced concrete post with a plurality of members made of sheet steel, and for providing the reinforced concrete post with sheet steel members into a unified entity. Further, the core concrete of the reinforced concrete post is at least partially enclosed in an effective manner by the sheet steel members to prevent the strength and rigidity thereof from deterioration resulting from breakdown by shearing forces caused by repeated deformation taking shape at the time of a severe earthquake in order to improve the quakeproof property of the concrete post. The process of covering the concrete post with a plurality of sheet steel members includes covering the peripheral surface of the concrete post with a plurality of sheet steel members in an end to end abutting relationship and splicing and joining the plurality of sheet steel members with each other at regular spacing.

Figure 1:
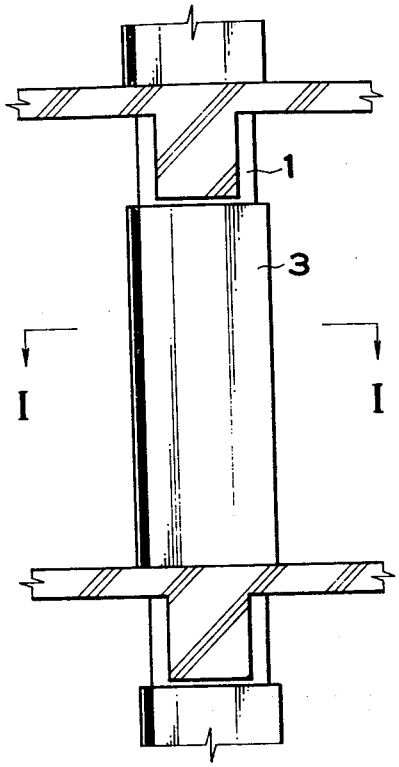
FIG. 1 is a front view of a reinforced concrete post showing an arrangement for covering the peripheral surface of a square post with a sheet steel member securely jointed at the butt ends thereof.

Referring now to the drawings wherein the showings are for the purpose of illustrating the preferred embodiment of the invention only and not for purposes of limiting same; FIG. 1 through FIG. 6 are such illustrations that a square reinforced concrete post 1 of an existing building includes, with a clearance of approximately 5mm along the periphery thereof, a plurality of multifarious types of sheet steel members properly worked in advance in a workshop into a properly dimensioned covering shape. These members are spliced together with the butt ends of each member being jointed with their adjacent counterparts by welding. The clearance formed between the square post 1 and the sheet steel members is then filled with cement paste, mortar, epoxy resin or the similar bonding agent generally designated by numeral 2, thus ensuring reinforcement of the reinforced concrete post. In other words, the existing reinforced concrete post 1 has the periphery thereof covered with a plurality of sheet steel members whose butt ends are securely jointed to their counterparts by welding and which further include a bonding agent 2 between the post and steel members to integrally unify the post into a single entity. This insures that the core concrete of the reinforced concrete square post 1 is restrained in an effective and secure manner to prevent breakdown thereof by shearing forces resulting from frequent, alternating and repeated deformation of the type generated when the building structure is subjected to, for example, earthquakes. Furthermore, it will be noted that execution of the process work can be carried out in a comparatively simple manner on an existing reinforced concrete post. As shown in the drawings, the spliced together steel plates completely encircle the circumference of the concrete post.

Figure 2:
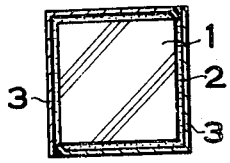
FIG. 2 is a cross-section as cut along the line I—I shown in FIG. 1.

Various examples of the method of jointing sheet steel members with one another area as shown in FIGS. 2–6 in the form of cross-sectional drawings. Shown in the illustration of FIG. 2 is a joint made by welding of the butt ends of a pair of L-shaped sheet steel members 3 in an orthogonal manner. This method features facilitation of treatment for a degree of dimensional error, since the joint section of the L-shaped sheet steel members permits an allowance to a degree.

Figure 3:
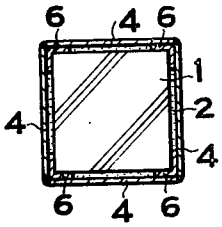
FIGS. 3–6 are transverse sections showing alternative arrangements for covering a square post on the surface thereof by the use of sheet steel members.
Figure 4:
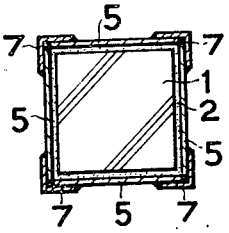

The arrangements shown in the illustrations of FIGS. 3 and 4 are such that four pieces of flat plate steel 4 or 5 are jointed orthodiagonally, i.e. in a mutually perpendicular postion, at both butt ends thereof, respectively. An angleshaped plate steel splice member 6 or 7 is conveniently spliced or mounted on either of the interior or exterior side of each joint section at the four corners thereof by the steel angles being conventionally jointed with flat plate band steel members 4, 5, respectively.

Figure 5:
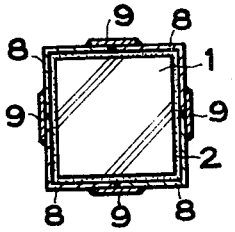

The arrangement shown in FIG. 5 is such that four pieces of plate steel angle 8 are butt-jointed with each other at the butt ends thereof, respectively. Flat splice plate steel members 9 are then spliced onto the exterior side of the joint sections thereof and then are conveniently jointed with the plate steel angle 8 by welding, respectively.

Figure 6:
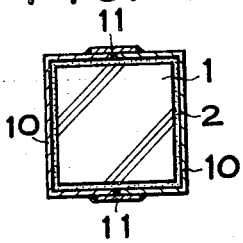

The arrangement shown in FIG. 6 is such that two pieces of channel plate steel 10 are butt-jointed with each other at both butt ends thereof. A flat plate-shaped splice plate steel 11 is then spliced onto the exterior side of each joint section, and jointed with the channel plate steel 10 in those positions by, for example, welding.

It will be appreciated that the process employed in obtaining arrangements discussed above also including the step of placing bonding agent 2 between the post and steel plating.

Figure 7:
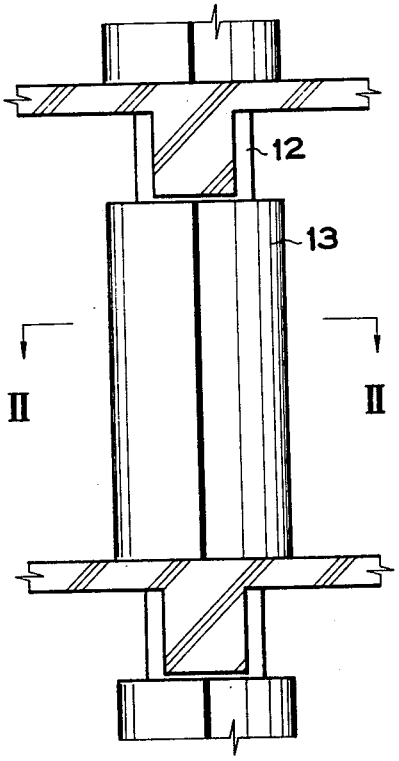
FIG. 7 is a front view of a reinforced concrete post showing an arrangement for covering a post with semicircular sheet steel members.
Figure 8:
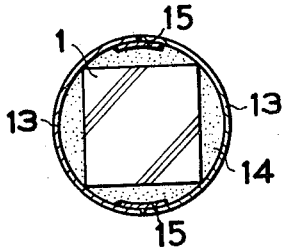
FIG. 8 is a section as cut along the line II—II shown in FIG. 7.
Figure 9:
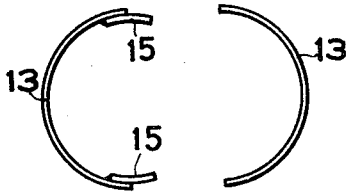
FIG. 9 is a plan view of the semicircular sheet steel member shown in FIG. 8.

The arrangement shown in FIGS. 7 and 8 are such that a pair of semicylindrical plate steel 13 members having a radius of curvature approximately one half the length of the diagonal of the square post 12 (FIG. 9) are disposed around the square post 12 in such a manner as to form a cylinder with the center of the axis of the square post selected as the center of the cylinder. Semicylindrical plate steel members 13 are then jointed with each other by welding at the both butt end sections for jointing and, thereafter a hardening agent 14 such as, for example, dilatable mortar or the like is placed into the clearance between the surfaces of the square post 12 and the pair of plate steel members 13. Thus, the square post 12 is covered with the plate steel 13 and formed into a unified entity. Accordingly, in this arrangement, and although post 12 is converted into a cylindrical post, the effects of the arrangement remain the same as hereinabove discussed. In this instance, the joint sections at the both butt ends of either one of the pair the semicylindrical plate steel members 13 include a splice piece 15 fixed thereto by convenient means such as welding and in such a manner that about one half thereof is projected outwardly therefrom. These projections assure that the two sections of plate steel 13 will be jointed with each other in a smooth and secure manner.

Figure 10:
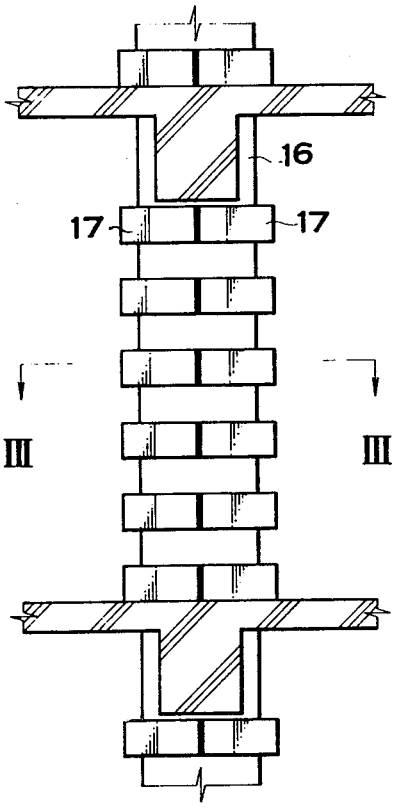
FIG. 10 is a front view of a reinforced concrete post showing an arrangement for covering the surface of a square post with a plurality of sheet steel belts.
Figure 11:
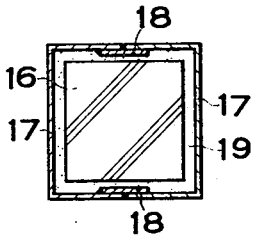
FIG. 11 is a section as cut along the line III—III shown in FIG. 10.

The arrangement shown in FIGS. 10 and 11 is such that a pair of channel-shaped band steel members 17,17 are formed in a manner so as to each encircle one half of the periphery of a reinforced concrete square post 16. A plurality of these bands are placed around the square post and longitudinally therealong to face each other so that square post 16 is substantially covered therewith. A flat steel splice piece 18 is fixed on the inside of each one of the both butt ends confronting each other in such a manner that both butt ends are connected with their respective counterparts. The butt end sections of the channel-shaped band steel members 17,17 and the splice plate steel 18 are jointed into a unified entity by convenient means such as welding and the clearance between the exterior surface of the square post 16 and the interior surface of channel-shaped band steel members 17 is filled with a bonding agent 19 comprising, for example, cement paste, mortar, epoxy resin or the like. This above process is continuously repeated until post 16 includes the number of desired channel pairs thereon to include the desired spacing therebetween.

Figure 12:
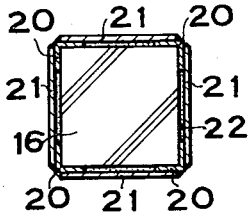
FIG. 12 is a transverse section of a reinforced concrete post which shows another arrangement of the subject invention wherein a square post is formed into a square shape through the use of a plurality of sheet steel belts.

The arrangement shown in FIG. 12 is such that an existing reinforced concrete square post 16 includes angleshaped splice steel members 20 spliced at each corner section thereof. The faces of the square post each have a flat band steel member 21 spliced continuously therealong with the butt ends thereof lapped on the associated of the angle-shaped splice steel members 20. These members are then jointed by welding or other convenient means into a unified entity and the clearance between the flat band steel member 21 and the faces of the square post 16 are filled with a bonding agent 22. Again, and as described above, this process is repeated until the proper length is reached, including the specified vertical spacing, along the length of square post 16.

Figure 13:
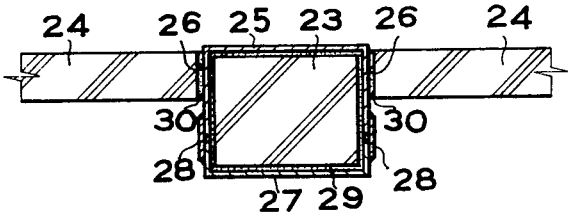
FIG. 13 is a transverse section of a reinforced concrete post which shows another arrangement of the subject invention wherein a post unified with a wall is formed into a square shape through the use of a plurality of sheet steel belts.

Illustrated in FIG. 13 is an arrangement for a reinforced concrete post 23 unified with a wall structure and which is reinforced by the application of virtually the same method as that shown in FIG. 10 above. In this instance, through holes recesses 26 are drilled in wall 24 to enable both butt ends of the channel-shaped bar or band steel member 25 to extend therethrough. Holes 26, of course, are spaced along wall 24 generally vertically of post 23 at intervals corresponding to the desired intervals of the plates along the post. The channel-shaped band steel plate 25 is spliced onto post 23 in such a manner as to surround the rear face section of the post so as to have both ends of the said band steel plate 25 inserted through the said holes 26. A channel-shaped band steel member 27 is likewise spliced onto post 23 in such a manner as to surround the front face section of the post from the front face thereof. Post 23 is set in place regularly with the two channel-shaped band steel members 25,27 confronting each other. Flat splice steel plates 28 are then spliced in place in such a manner that both butt ends of the channel-shaped band steel members 25,27 are connected with each other. These are jointed together with each other into a unified entity, by welding, or other convenient means, plates 28 thereto. The clearance area between the faces of post 23 and the band steel members 25,27 is then filled with a bonding agent 29. The clearance between holes 26 and steel members 25,27 is filled with mortar 30.

Figure 14:
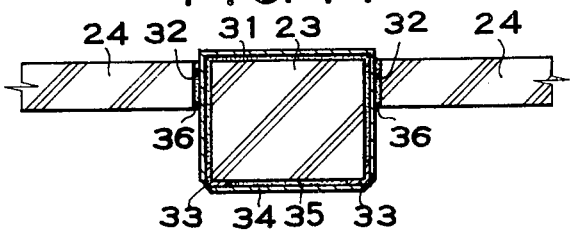
FIG. 14 is a transverse section of a reinforced concrete post showing yet another illustration of a post unified with a wall being formed into a square shape through the use of a plurality of sheet steel belts.

Illustrated in FIG. 14 is an arrangement wherein through holes 32 in wall 24 enable both end sections of a channel-shaped band steel member 31 to be inserted therethrough. These holes are drilled in a plurality of locations at the desired vertical spacing in the wall along the sides of reinforced concrete post 23 which is unified with the wall. A channel or generally U-shaped band steel plate member 31 is spliced from the rear face of post 23 in such a manner as to surround the rear face section thereof by inserting both ends of member 31 into through holes 32. Angle-shaped splice steel plate members 33 are then spliced at each corner section of the front face side of post 23. These angle-shaped splice steel plate members 33 have the butt end sections of the legs of channel-shaped band steel plate member 31 lapped thereover and are fixed to each other by convenient means such as welding. Then, both butt ends of a flat band steel plate member 34 are spliced in such a manner as to connect the two angle-shaped splice steel plate members 33 and are affixed thereto by convenient means such as welding so that post 23 is covered with the channel-shaped band steel plate member 31 and the flat band steel plate member 34. The clearance between the four faces of post 23 and channel-shaped band steel plate member 31 and flat band steel plate member 34 is filled with a bonding agent 35. The clearance area between the through holes 32 and the legs member 31 is filled with mortar or cement 36. Again, this process is repeated until proper desired length of post 23 is covered, having the spacing between consecutive plates or dictated by the particular building arrangement.

Figure 15:
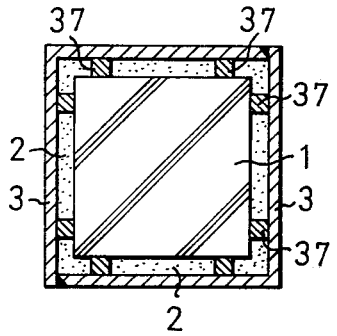
FIG. 15 is a transverse section showing an arrangement for retaining the clearance between a reinforced concrete post and sheet steel members.
Figure 16:
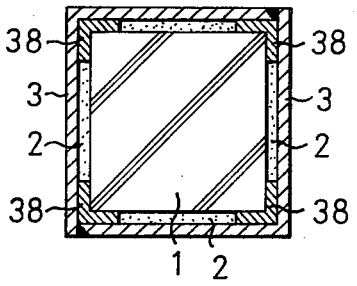
FIG. 16 is a transverse section showing another arrangement for retaining the clearance between a reinforced concrete post and sheet steel members.

FIG. 15 and FIG. 16 are views of means for retaining the clearance between a concrete post and sheet steel member.

Figure 17:
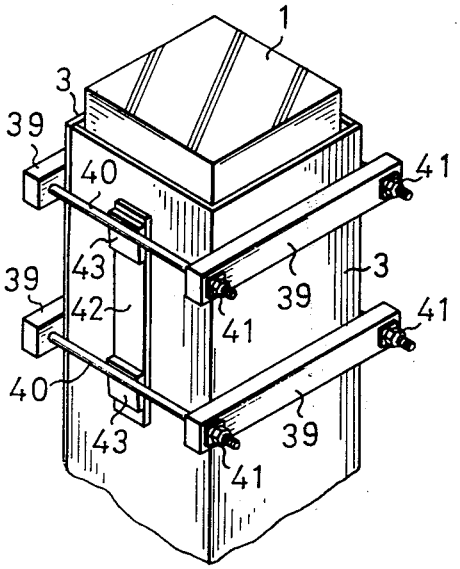
FIG. 17 is a perspective view showing a means for supporting sheet steel members.

FIG. 15 is explained hereinafter with the reference to FIG. 2. A plurality of strip-like spacers 37 of a thickness being substantially equal to the required clearance are longitudinally bonded to the inner surface of L-shaped steel members 3 at desired intervals, such as 30cm. The spacers may be a strip made of wood, iron, synthetic resin, or mortar. The spacers 37 bonded to the L-shaped steel members 3 are fitted to the surface of the reinforced concrete post, and steel member 3 are pressed at the fitting place by the use of hands or a temporary supporting assembly as shown in FIG. 17, for the time of welding or depositing.

FIG. 16 is explained hereinafter in the case of FIG. 2. L-shaped spacers 38 are pre-bonded longitudinally along the four corners of the reinforced concrete post, and thereafter L-shaped sheet steel members 3 are fitted to the spacers 38, and pressed by the use of hands or a temporary supporting assembly as shown in FIG. 17 hereinafter explained, for the time of welding or depositing.

The clearance retaining means shown in FIG. 15 also can be used in the embodiments of FIGS. 4, 5, 6, 11, 13 and 14 in the like manner, and said means in FIG. 16 also can be used in the embodiments of FIGS. 4, 5, and 6 in the like manner.

In the embodiments of FIG. 3, the clearance is retained by the angle plate 6, and in the embodiment of FIG. 12 by the angle plate 20.

Figure 18:
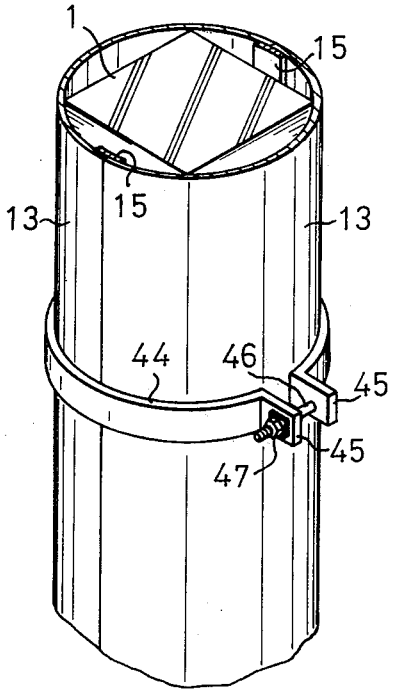
FIG. 18 is a perspective view showing a means for supporting a semi-circular sheet steel members.

FIGS. 17 and 18 shows the supporting assembly for fixing the sheet steel members to the reinforced concrete post for the time of welding or depositing.

Explained hereinafter about FIG. 17, referring to FIG. 2, wherein the reinforced concrete post 1 is covered with L-shaped sheet steel members.

When L-shaped sheet steel members 3 are fitted to the reinforced concrete post 1 as shown in FIGS. 15 and 16, bar members 39 are transversely disposed in the opposite two surfaces of L-shaped sheet steel members, both at the same level, wherein both ends of the bar members 39 extending from the L-shaped sheet steel members 3 are securely connected by bolt 40 and nut 41.

On the other side surfaces of L-shaped sheet steel members on which no bar members are disposed, an abutting plate 42 is disposed, and wedge plate 43 is driven into between the abutting plate 42 and the bolt 40 for securely fixing the L-shaped sheet steel members 3.

Thus composed supporting assembly will be provided in a plurality of portions longitudinally of the reinforced concrete post 1 in the embodiments of FIGS. 3, 4, 5, 6, 11 and 12. The supporting assembly is broken away after welding or depositing is completed.

The supporting assembly shown in FIG. 18 is applicable for the semi-circular sheet steel member 13 covering the reinforced concrete post 1 in FIG. 8. More specifically, when two semi-circular sheet steel members 13 are fitted to the reinforced concrete post 1, a steel band 44 having brackets 45 at its opposite ends extending therefrom at right angle is placed around the fitted steel members 13 and the bracket 45 are securely connected by bolt 45 and nut 47 for supporting the steel member 13. It will be appreciated that the steel band 44 may be in the shape of semi-circular, where a pair of steel bands are placed around the sheet steel members, and the opposite ends thereof are securely connected each other by the use of bolt and nut.

Referring to FIG. 10 wherein the reinforced concrete post 16 is covered by a plurality of a pair of band steel members 17 each pair of which are disposed therearound with a predetermined space longitudinally along the post 16 from the other pair of band steel members, the lower edge of each band steel members 17 is closed with any suitable wooden plate, so that the bonding agent will not drop down from the clearance between the post 16 and the band steel member 17. Subsequently, the band steel member 17 fitting to the reinforced concrete post is pressed by hands during welding or depositing. The embodiments in FIGS. 13 and 14 are arranged in the same manner above described.

When reinforcing a post by the application of the above described new invention, the reinforcement need not always be carried out on all the faces of the post. For example, reinforcement may be effected on only a part of the post near the top or bottom ends thereof as may be dictated by a specific architectural need.

The invention has been described with reference to preferred embodiments thereof. Obviously, modifications and alterations will occur to others upon the reading and understanding of this specification. It is my intention to include all such modifications and alterations insofar as they come within the scope of the appended claims or the equivalents thereof.

Having thus described our invention we now claim:

1. In a pre-existing structurally sound load bearing reinforced concrete post, the method of maintaining the load bearing capacity of said post with bands during earthquake tremors, comprising the steps of:

(a) providing a plurality of band segments, (b) bonding spacers to said band segments, (c) securing said segments around said post, thus fitting the spacers to said post, (d) fastening the segments together, thus completely forming said bands, (e) vertically spacing apart said bands one from the other along the longitudinal axis of said post, (f) interposing a hardenable bonding agent between said post and said bands, and (g) permitting said bonding agent to harden sufficiently to convert said post, bonding agent and bands into an integral structure, whereby decrease of load bearing capacity of said post is minimized by said bonded bands when said post is subjected to the attrition of flexing and shear due to earthquake tremors.

* * * * *